US005259780A

United States Patent [19]

Morrissey, III et al.

[11] Patent Number: 5,259,780

[45] Date of Patent: Nov. 9, 1993

[54] QUICK DISCONNECT WIRING CONNECTOR

[75] Inventors: Edmund J. Morrissey, III; James B. Robertson, both of Aptos; Gregory E. Landreth, Los Gatos, all of Calif.

[73] Assignee: Plantronics, Inc., Santa Cruz, Calif.

[21] Appl. No.: 887,452

[22] Filed: May 21, 1992

[51] Int. Cl.[5] ..... H01R 13/28

[52] U.S. Cl. ..... 439/292; 439/460

[58] Field of Search ..... 439/284, 287, 290, 291, 439/292, 293, 295, 460, 464, 465, 731

[56] References Cited

U.S. PATENT DOCUMENTS

| | | | |
|---|---|---|---|
| 350,293 | 10/1986 | Cox | 439/290 |
| 2,460,231 | 1/1949 | Matthysse | 439/290 |
| 2,591,437 | 4/1952 | Jun | 439/290 |
| 4,537,456 | 8/1985 | Brown et al. | 439/293 X |
| 4,702,538 | 10/1987 | Hutter et al. | 439/292 |
| 4,737,118 | 4/1988 | Lockard | 439/293 X |

FOREIGN PATENT DOCUMENTS

| | | | |
|---|---|---|---|
| 2648820 | 5/1978 | Fed. Rep. of Germany | 439/290 |

*Primary Examiner*—Larry I. Schwartz
*Assistant Examiner*—Khiem Nguyen
*Attorney, Agent, or Firm*—Arnold, White & Durkee

[57] ABSTRACT

A separable connector for electrically coupling two portions of multiple-conductor cable is disclosed. The connector, in a connected state, is held together by operation of the novel shape of the connector halves. The two connector halves, which each include therein a plurality of metallic contact strips, are identical and "gender neutral", such that any two connector halves may be coupled together. Connection of the connector halves is accomplished by pushing the two halves together; disconnection is accomplished by pulling them apart. When connected, continuous electrical contact is maintained between contact strips in each respective half. The connector is constructed of molded plastic, and includes rubber strain relief collars for preventing fatigue and failure of the attached portions of multiple conductor cable.

1 Claim, 8 Drawing Sheets

FIG.2a
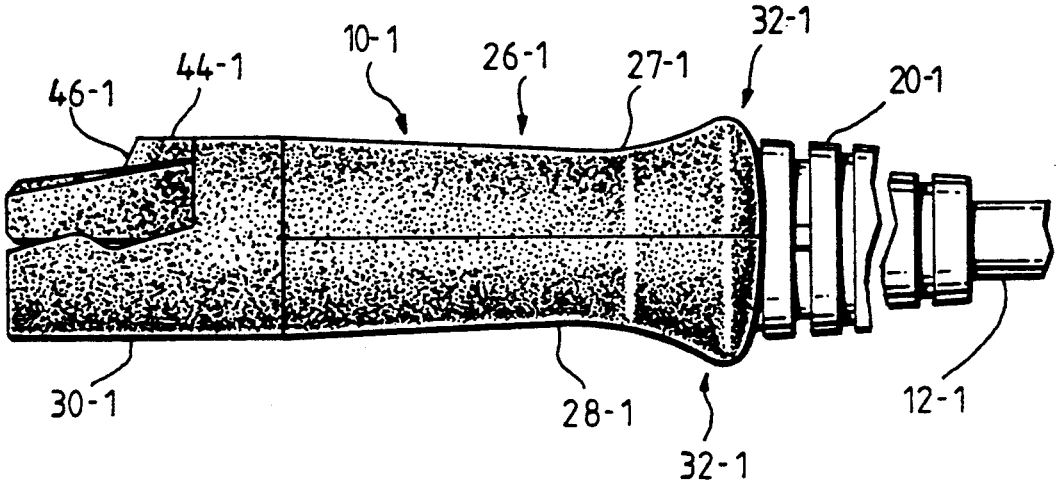
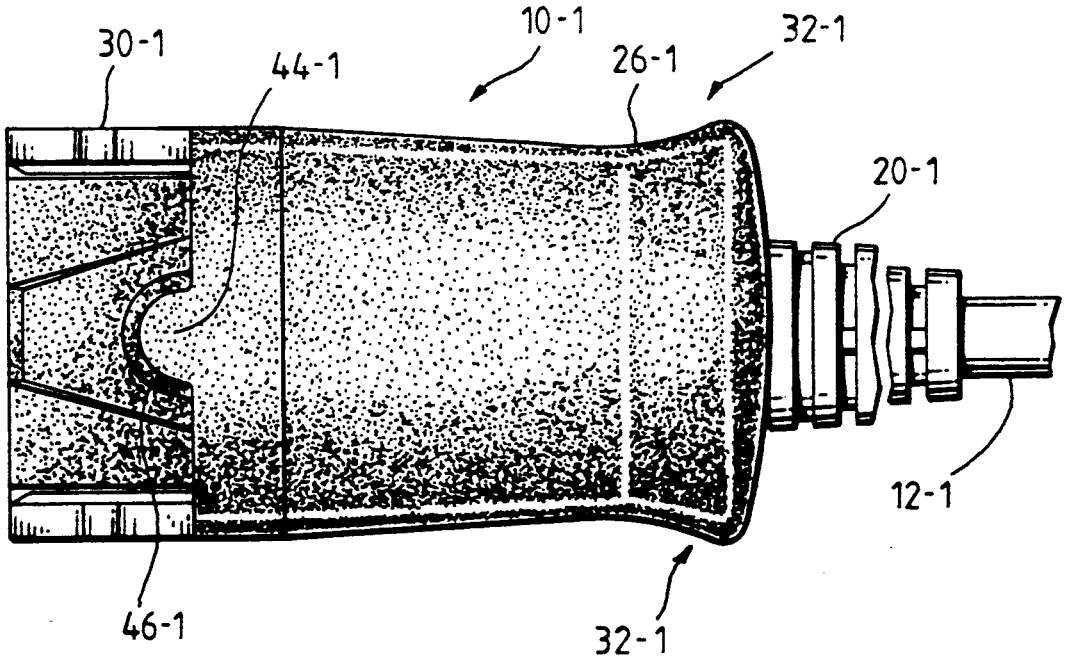
FIG.2b

FIG.3a
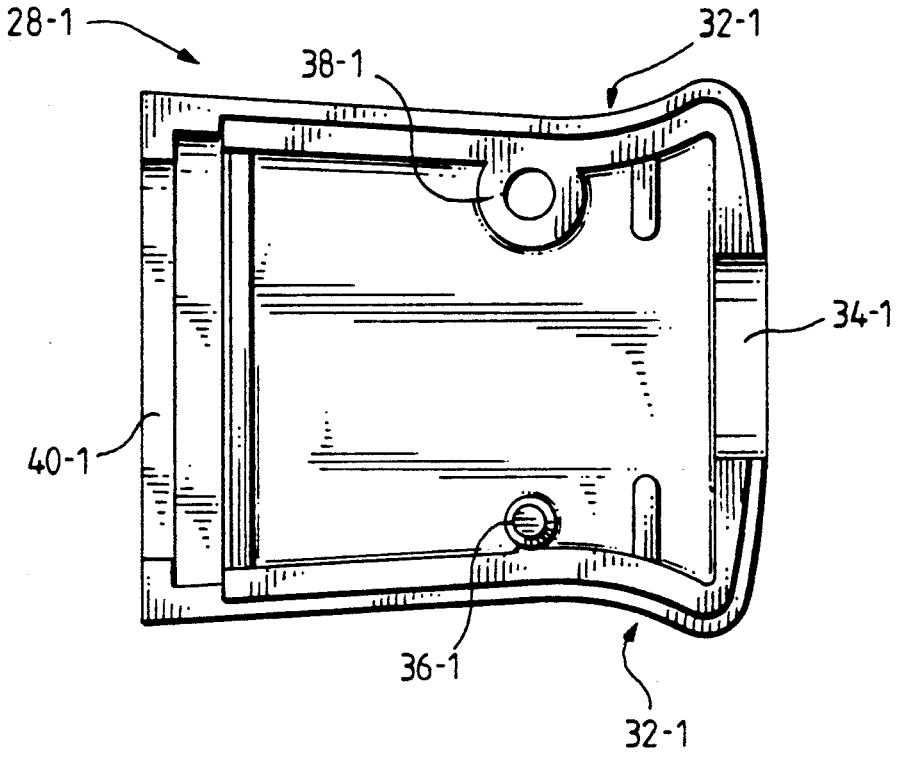
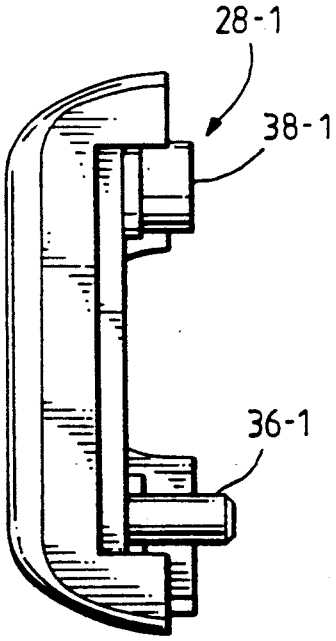
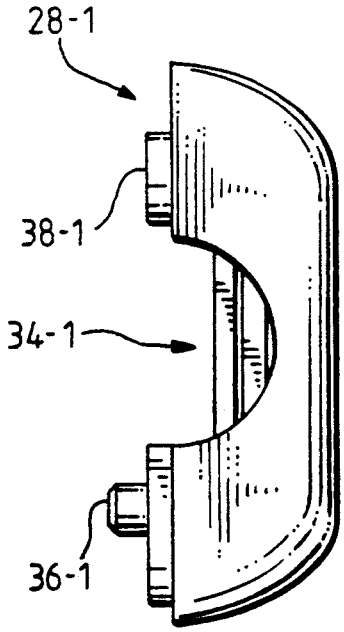
FIG.3b
FIG.3c

FIG.7a
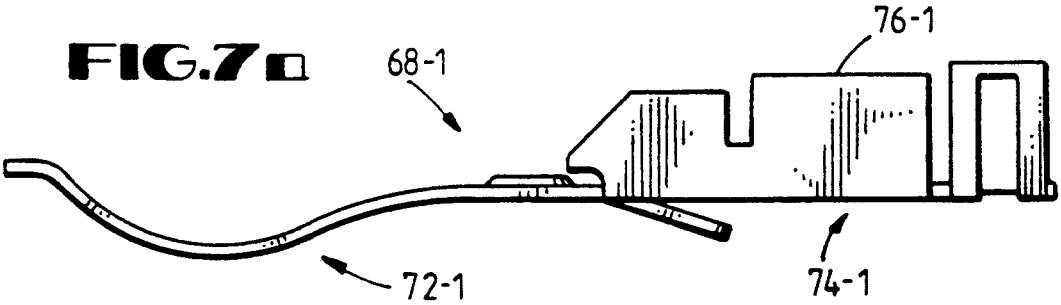
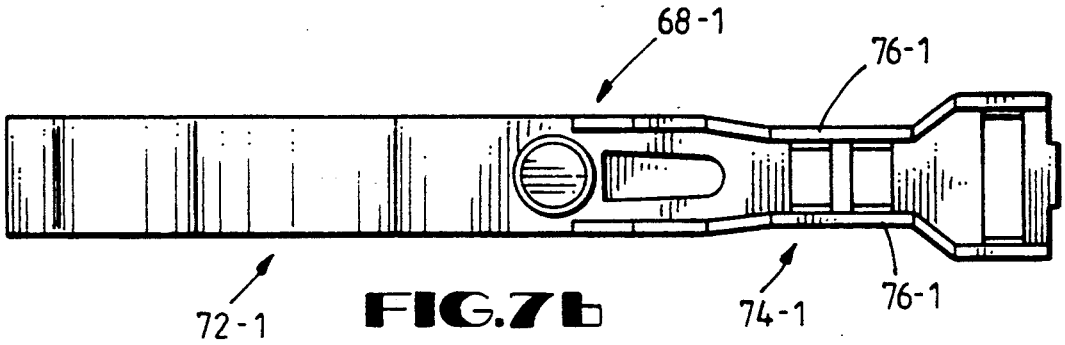
FIG.7b
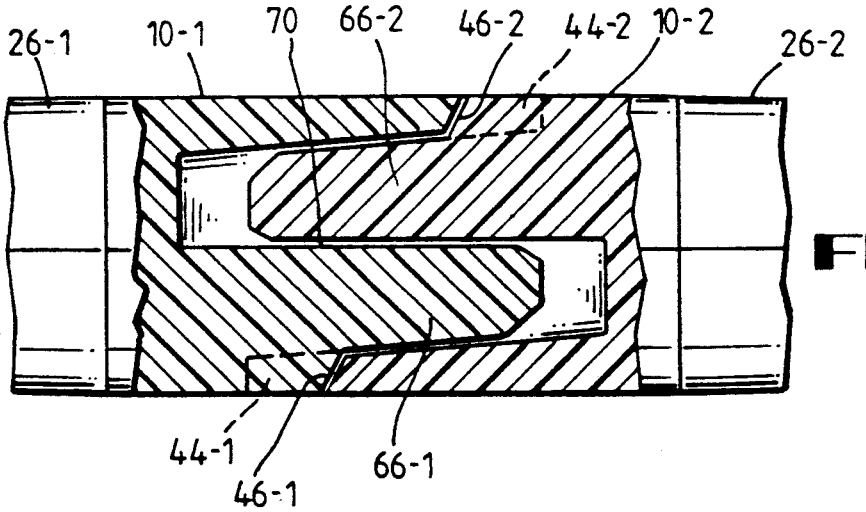
FIG.6
FIG.8
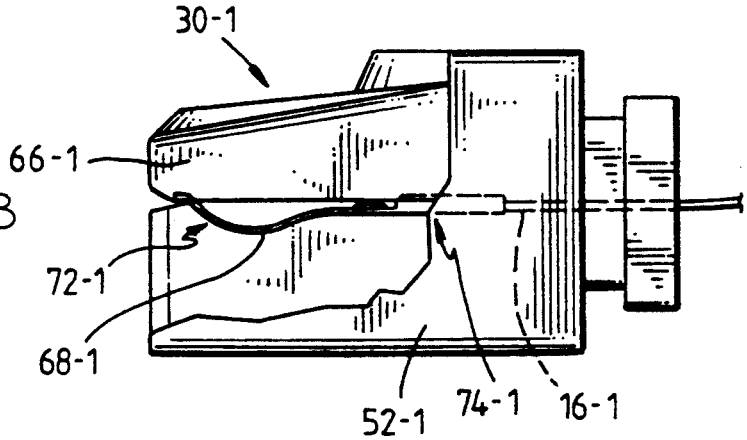

QUICK DISCONNECT WIRING CONNECTOR

FIELD OF THE INVENTION

This invention relates to the field of cable connectors, and more particularly to an apparatus which allows two multiple-conductor cables to be quickly connected or disconnected.

BACKGROUND OF THE INVENTION

There are many circumstances in which it is desirable for a cable to be provided with a connector at some point along its length, such that the portions of cable on either side of the connector may be temporarily disconnected from one another, and then re-connected. For example, in the case of telephone headsets which are coupled with a cable to a stationary base unit, the wearer may wish to momentarily move away from the base unit without having to remove the headset or microphone.

If the cable between the headset and base unit is provided with a separable connector at some point along its length, however, mobility can be achieved merely by separating the connector. Thus, in the case of a headset or microphone, the wearer can move freely about by simply disconnecting the headset from the base unit. When the wearer returns to the base unit, he can re-connect the headset to its base unit.

Several important considerations must be taken into account if an effective and practical separable cable connector is to be provided. First, when the connector is connected, it must maintain continuous and affirmative electrical contact between conductors in the two connected portions of cable. While connected, normal movement of the cable should not cause an interruption of the electrical contact between the respective portions of wiring. At the same time, however, the connector should not be so securely fastened as to make disconnection too difficult or time consuming. Screw-type connectors, although they may provide a durable and secure connection, are not desirable in many situations, since the rotation required to fasten and unfasten them may cause the respective portions of wiring to become twisted and knotted.

Another consideration is the size and weight of the connector. If the connector is to be used for a headset cord, for example, the connector should not be so heavy or large as to make the wearer uncomfortable. Achieving sufficiently small size and light weight in a connector may be difficult, however, particularly when the cable comprises multiple conductors. Moreover, although the connector should preferably be small and light, it should not be so fragile that it is prone to breakage during ordinary use, or after repeated connecting and disconnecting. Standard modular connections commonly associated with residential telephone equipment, for example, are small, lightweight, and provide a reliable electrical connection between multiple conductors; however, such connectors are not durable, and are not intended to withstand frequent connection and disconnection.

It is accordingly a feature of the present invention that a multiple-conductor cable connector is provided which is durable and capable of withstanding repeated connection and disconnection.

It is another feature of the present invention that the multiple-conductor cable connector is small and lightweight, but which nonetheless provides an affirmative electrical connection between respective conductors in two connected portions of cable.

It is also a feature of the present invention that the connector is quickly and easily separated and connected, but which is not prone to inadvertent separation.

It is a further feature of the present invention that the wiring connector is gender-neutral. That is, the connector in accordance with the present invention comprises two identical, separable halves, having a form which allows any one connector half to be coupled to any other.

SUMMARY OF THE INVENTION

In accordance with the present invention, a separable cable connector capable of being quickly connected and disconnected is provided which is lightweight and durable. The connector in accordance with one embodiment of the invention comprises two identical halves made of a lightweight plastic material surrounding metallic contacts. Each of the connector halves receives the end of a multiple-conductor cable. Disconnection is accomplished by pulling the two halves of the connector apart. When the halves of the connector are pushed together, curved portions of the surrounding plastic on the two halves interlock with one another. When fastened together in this manner, metallic contact strips disposed within one of the connector halves are received into contact with corresponding metallic contact strips similarly disposed within the other connector half, thereby establishing electrical contact between conductors in the respective portions of cable.

BRIEF DESCRIPTION OF THE DRAWINGS

The foregoing and other features of the present invention shall be more readily understood with reference to the detailed description of a specific embodiment of the invention, when read in conjunction with the drawings, wherein:

FIGS. 2*a* and 2*b* are enlarged side and top views, respectively, of one of the two identical connector halves comprising the wiring connector of FIGS. 1*a* and 1*b;*

FIGS. 3*a*, 3*b*, and 3*c* are enlarged top, front, and rear views, respectively, of one of the two halves of the housing portion of the connector half of FIGS. 2*a* and 2*b;*

FIG. 6 is a cross-sectional view of the mating portions of the connector of FIG. 1 in a connected state;

FIGS. 7*a* and 7*b* are enlarged side and top views, respectively, of an electrical contact strip in the connector of FIG. 1;

FIG. 8 is an enlarged side view of the mating portion of FIGS. 4*a*–4*d*, cut away to show the connector strip disposed therein.

DETAILED DESCRIPTION OF SPECIFIC EMBODIMENTS OF THE INVENTION

Figure 1A:
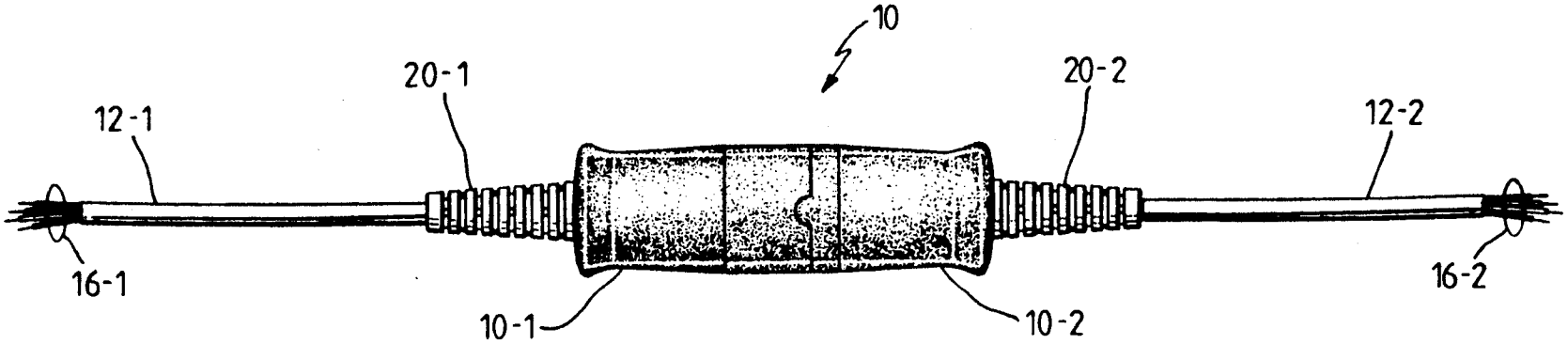
FIGS. 1*a* and 1*b* are illustrations of a wiring connector in accordance with one embodiment of the present invention in a connected and unconnected state, respectively.
Figure 1B:
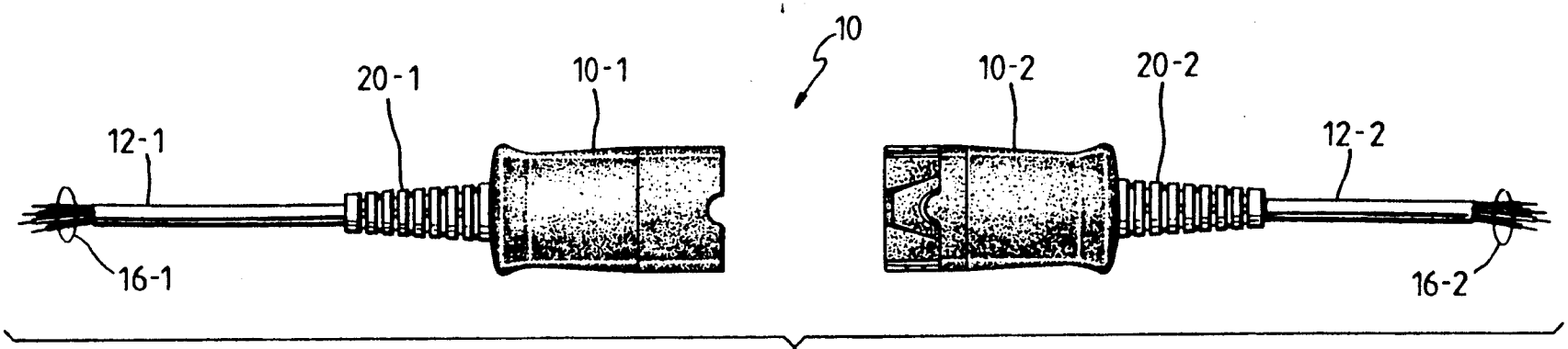

Referring to FIGS. 1*a* and 1*b*, a separable cable connector 10 in accordance with the present invention is shown. In FIG. 1*a*, separable connector 10 comprising connector halves 10-1 and 10-2 is shown in its connected state, establishing electrical contact between the multiple conductors contained with cables 12-1 and 12-2. In accordance with an advantageous feature of the present invention which shall hereinafter become apparent, connector half 10-1 is identical to connector half 10-2. Connector 10 in accordance with the present invention comprises two identical, "gender-neutral" halves, such that any one connector half such as 10-1 or 10-2 can be connected to any other connector half. In the following description of a specific embodiment of the invention, it is to be understood that any description of connector half 10-1 of connector 10 shall be equally applicable to connector half 10-2. For the purposes of the following description, components of connector half 10-1 shall be designated with reference numerals having a "-1" (dash one) suffix, whereas corresponding and identical components of connector half 10-2 shall be designated with identical reference numerals as those used for connector half 10-1, except that they shall be followed with a "-2" (dash two) suffix.

Cables 12-1 and 12-2 each comprise a flexible plastic or rubber outer insulative sheathing which surrounds a plurality of individually insulated wires designated collectively in FIGS. 1*a* and 1*b* as 16-1 and 16-2, respectively. In one embodiment of the present invention suitable for use in connecting a telephone headset to a stationary telephone base unit, cables 12-1 and 12-2 contain four separate wires.

Connector halves 10-1 and 10-2 are composed of a suitable rigid plastic material such as Teflon TM -filled acetal or the like, and contain metallic contacts which shall be hereinafter shown and described in greater detail. Associated with each of the connector halves 10-1 and 10-2 are flexible strain relief collars 20-1 and 20-2, respectively, which limit sharp bending of flexible cables 12-1 and 12-2 at the respective interfaces with connector halves 10-1 and 10-2, since such sharp bending can lead to metal fatigue and eventual failure of the internal conductors 16-1 and 16-2. In FIG. 1*b*, connector 10 is shown in a disconnected state, connector halves 10-1 and 10-2 having been pulled apart.

Turning now to FIG. 2*a*, a greatly enlarged side view of one of the connector halves 10-1 is shown. Assembled connector half 10-1 in FIG. 2*a* is composed of a housing 26-1 comprising upper and lower halves 27-1 and 28-1, respectively, and a mating portion 30-1. Flexible strain relief collar 20-1 and cable 12-1 extend from the rear portion of housing 26-1. Housing 26-1 comprises upper and lower halves 26-1 and 26-2 so that during manufacture of connector half 10-1, strain relief collar 20-1 and cable 12-1 may be received therein, with wires 16-1 within cable 12-1 extending through housing 26-1 and electrically coupled to metallic contacts in mating portion 30-1, as shall be hereinafter described. During manufacture, upper and lower housing portions 27-1 and 28-1 are permanently joined, as with glue, thermal bonding or the like. It is to be understood that although connector half 10-1 is described as comprising three separate components 27-1, 28-1 and 30-1, these three components are permanently assembled during manufacture to form a unitary connector half which is not thereafter disassembled. It is also be understood that a connector in accordance with the present invention may comprise more or less than the three principle components as herein described, depending upon the materials and manufacturing process employed in a given implementation.

In FIG. 2*b*, a greatly enlarged top view of assembled connector half 10-1 is shown. As can be seen from FIGS. 2*a* and 2*b*, the rear portion of housing 26-1 flares outward slightly, in the areas denoted generally as 32-1 in FIGS. 2*a* and 2*b*. The outward flare at areas 32-1 of housing 26-1 facilitates the gripping of connector half 10-1 when it is being pulled apart from another connector half.

In FIGS. 3*a*, 3*b*, and 3*c*, top, front, and rear views, respectively, of lower housing half 28-1 is shown. A semi-circular opening 34-1 in the rear of housing half 28-1 is provided to receive strain relief collar 20-1 and cable 12-1. A protruding pin 36-1 and a circular sleeve 38-1 are molded as integral parts of housing half 28-1 in order to facilitate the joining of an upper and lower housing during manufacture. As would be apparent to one of ordinary skill in the design and assembly of plastic parts, housing half 27-1 would be substantially identical to housing half 28-1, except that the placement of pin 36-1 and sleeve 38-1 would be reversed; thus, when two housing halves 27-1 and 28-1 are brought together, pin 36-1 of housing half 28-1 would be received in a sleeve substantially identical to sleeve 38-1 in housing half 28-1, while sleeve 38-1 in housing half 28-1 would receive a pin substantially identical to pin 36-1 in housing half 27-1. In FIG. 3*a*, shaded region 40-1 represents a T-shaped cavity which receives mating portion 30-1 as shall hereinafter become apparent. When upper and lower housings 27-1 and 28-1 are brought together, semicircular opening 34-1 in housing half 28-1 and a corresponding semicircular opening in housing half 27-1 would form a circular opening for receiving strain relief collar 20-1 and cable 12-1.

Figure 4B:
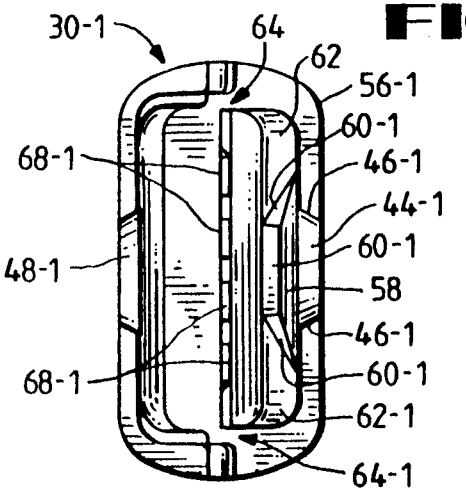
FIGS. 4*a*, 4*b*, 4*c* and 4*d* are enlarged top, front, bottom, and side views, respectively, of the mating portion of the connector half of FIGS. 2*a* and 2*b;*
Figure 4D:
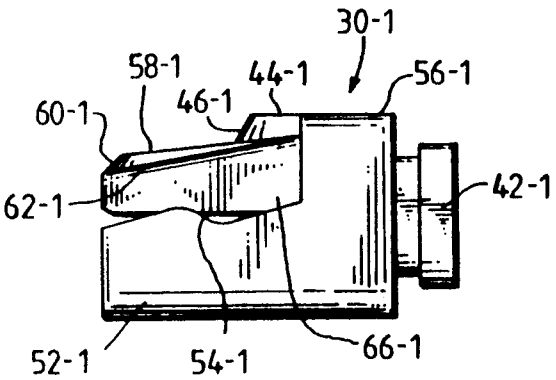
Figure 4A:
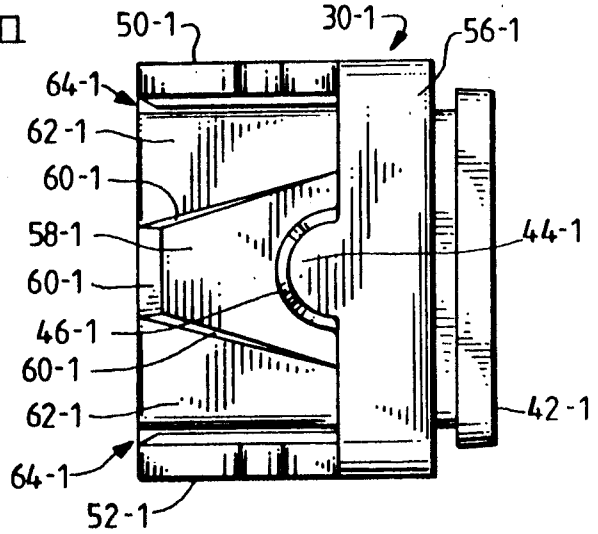
Figure 4C:
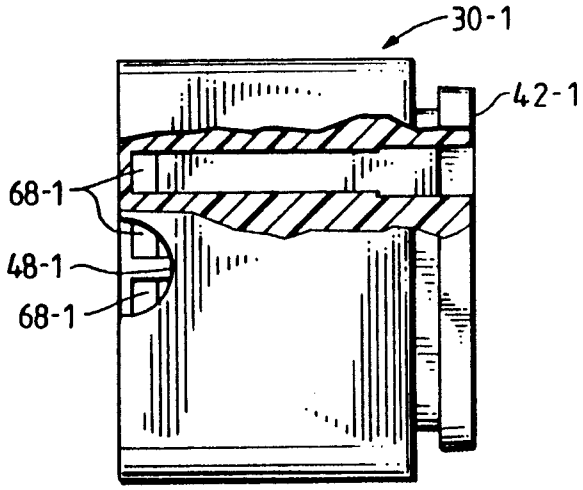

Turning now to FIGS. 4*a*, 4*b*, 4*c* and 4*d*, top, front, bottom, and side views, respectively, of mating portion 30-1 are shown, greatly enlarged. In FIGS. 4*a*, 4*b*, and 4*d*, a T-shaped protrusion 42-1 is shown extending from the rear of mating portion 30-1. T-shaped protrusion 42-1 is received in T-shaped cavity 40-1 of housing half 28-1 from FIGS. 3*a*, 3*b*, and 3*c* (and a similar opening in housing half 27-1) during assembly of connector 10. In accordance with the presently disclosed embodiment of the invention, mating portion 30-1 is preferably constructed as a single, molded plastic piece. In the top view of FIG. 4*a*, a semi-circular projection 44-1 defined in the top plane of mating portion 30-1 is shown. Semi-circular projection 44-1 has tapered edges 46-1, as can be more clearly understood with reference to FIGS. 4*b* and 4*d*. A semi-circular notch 48-1 is formed in the bottom plane of mating portion 30-1, as shown in FIGS. 4*b* and 4*c*. As shall be hereinafter described, two connector halves 10-1 and 10-2 are connected with one of the halves being upside-down with respect to the other, so that semi-circular projection 44-1 of connector half 10-1 is received within semi-circular notch 48-2 of connector half 10-2 (and similarly projection 44-2 is received within notch 48-1). The projections 44-1, 44-2 and notches 48-1, 48-2 thus facilitate alignment of connector halves 10-1 and 10-2 during connection.

As can be seen in FIG. 4*d*, projecting forward from the rear of mating portion 30-1 is a substantially planar, shelf-like projection 66-1, shown shaded in FIG. 4*d*. On the underside of planar projection 66-1 are disposed a plurality of metallic contact strips 68-1, one of which is visible in the cut-away section of FIG. 4*c*. Projection 66-1 thus serves as a support platform for contact strips 68-1 and will therefore be hereinafter referred to as contact support 66-1. Metallic contact strips 68-1 shall be hereinafter described in greater detail with reference to FIGS. 7*a*, 7*b*, and 8. The top surface of contact support 66-1 steps downward from rear to front, defining three separate planes. The rear of mating portion 30-1, as well as semi-circular projection 44-1 define a first planar surface, denoted as 56-1 in FIGS. 4*a*, 4*b*, and 4*d*. The tapered edges 46-1 of semicircular projection 44-1 extend down to a trapezoidal area 58-1 defining a planar surface which is sloped downward slightly from rear to front. Trapezoidal area 58-1 has sloped edges 60-1 which extend down to a third planar surface 62-1, which also slopes downward from rear to front at an angle slightly greater than that of trapezoidal area 58-1.

As shown for side 52-1 in FIG. 4*d*, the right and left sides 50-1 and 52-1, respectively, of mating portion 30-1 are only about one-half the height of the connector as a whole. Note from FIGS. 4*b* and 4*d* that sides 50-1 and 52-1 extend upwards at right angles from the planar bottom 53-1 of mating portion 30-1. In FIG. 4*d*, the inner surface of bottom 53-1 is indicated by a dashed line designated as 57-1. Thus, as can be seen in FIG. 4*d*, the inner surfaces of planar bottom 53-1 and contact support 66-1, along with sides 50-1 and 52-1, define a hollow cavity within mating portion 30-1. Metallic contact strips 68-1 are disposed on the underside of contact support 66-1 and thus are disposed on the upper wall of the cavity in mating portion 30-1. This cavity is capable of receiving the contact support 66-2 from mating portion 30-2 of connector half 10-2, as shall be hereinafter described. Note from FIGS. 4*c* and 4*d* that bottom 53-1 and sides 50-1 and 52-1 serve to protect metallic contact strips 68-1 disposed on the underside of contact support 66-1. Contact with contact strips 68-1 can only be made by objects small enough to fit within the cavity defined by contact support 66-1 and bottom 53-1 and sides 50-1, 52-1 of mating portion 30-1. Thus, for example, a person cannot touch contact strips 68-1 with his finger, which is desirable in order that problems with oxidation and/or corrosion of contacts 68-1 might be avoided.

The top edges of sides 50-1 and 52-1 define a smooth curve designated as 54-1 in FIG. 4*d*. Contact support 66-1 extends forward from the rear of mating portion 30-1 and is not connected to sides 50-1 and 52-1; that is, there are small gaps, designated as 64-1 in FIGS. 4*a* and 4*b*, between contact support 66-1 and sides 50-1, 52-1 of mating portion 30-1.

Figure 5A:
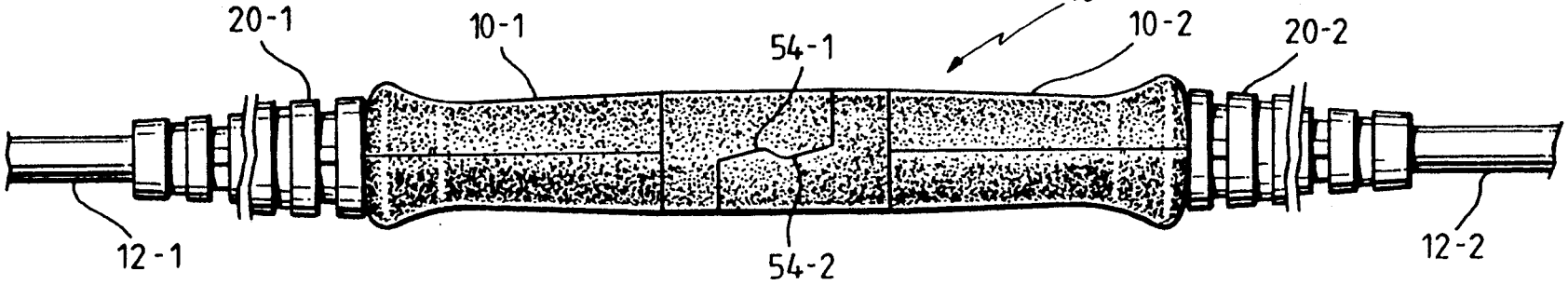
FIGS. 5*a* and 5*b* are enlarged side and top views, respectively, of the connector of FIGS. 1*a* and 1*b* in a connected state.
Figure 5B:
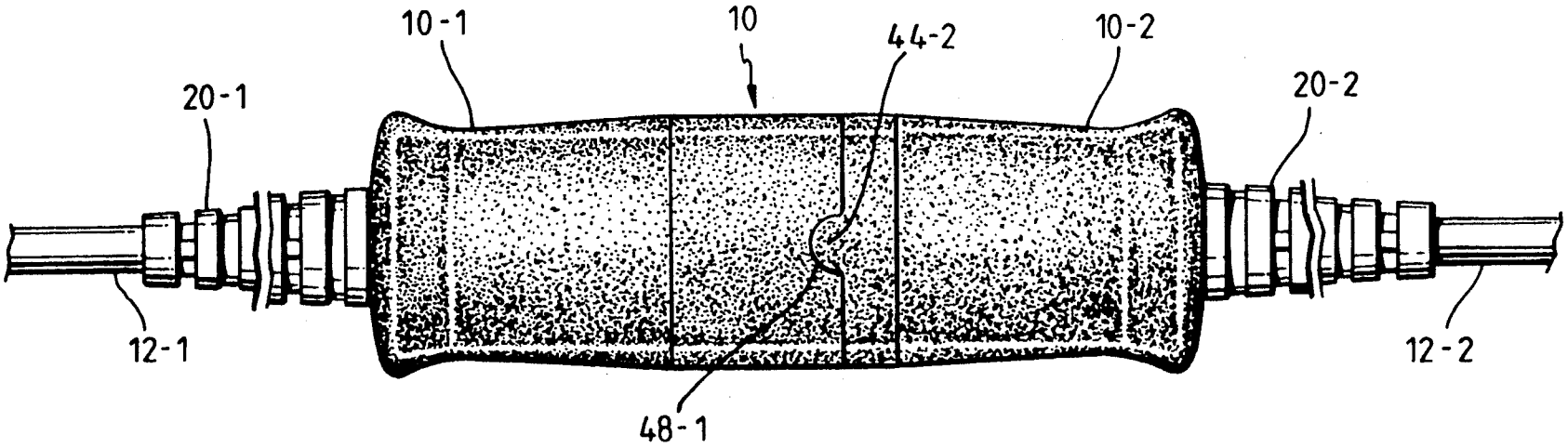

Turning now to FIGS. 5*a* and 5*b*, side and top views, respectively, of connector halves 10-1 and 10-2 in a connected position are shown. In FIGS. 5*a* and 5*b*, the boundaries between individual components of the respective connector halves 10-1 and 10-2 are represented with dashed lines, in order that the boundary between connector halves 10-1 and 10-2 may be more readily apparent.

As previously noted, connector 10 in accordance with the present invention comprises two connector halves 10-1 and 10-2 which are substantially identical. Connector halves 10-1 and 10-2 are connected by bringing together the respective mating portions 30-1 and 30-2 from the connector halves 10-1 and 10-2, with one of the mating portions being upside-down with respect to the other. As can be seen in FIG. 5*a*, when mating portions 30-1 and 30-2 of the respective connector halves 10-1 and 10-2 are brought together, smooth curves 54-1 (previously described with reference to FIG. 4*d*) on each side of mating portion 30-1 of connector half 10-1 are engaged with corresponding smooth curves 54-2 on the sides of mating portion 30-2. It is this interlocking of smooth curves 54-1 and 54-2 which holds connector halves 10-1 and 10-2 together when connector 10 is in a connected state. Since connector halves 10-1 and 10-2 are made of Teflon TM -filed acetal, which is somewhat flexible, connector halves 10-1 and 10-2 may be pulled apart by applying approximately 1½ pounds of force. When this force is applied, sides 50-1 and 52-1 of connector half 10-1 flex upward slightly, and sides 50-2 and 52-2 of connector half 10-2 flex downward slightly, allowing smooth curves 54-1 and 54-2 to disengage from one another. As an alternative to pulling connector halves 10-1 and 10-2 axially apart to separate them, the halves may be separated by grasping connector 10 at each end and "folding" or "breaking" the two halves apart.

As can be seen in FIG. 5*b*, when connector halves 10-1 and 10-2 are brought together, semi-circular projection 44-2 defined in the top of mating portion 30-1 is received in semi-circular notch 48-1 formed in the bottom plane of connector half 10-1, previously described with reference to FIG. 4*c*. Similarly, notch 48-2 in connector half 10-2 (which notch 48-2 is not visible in FIG. 5*b*) receives semi-circular projection 44-1 defined in the top of the mating portion 30-1 of connector half 10-1.

Turning to FIG. 6, a cross-sectional view of the mating portions of connector halves 10-1 and 10-2 from FIG. 5*b* is shown. In particular, the view in FIG. 6 corresponds to the section indicated in FIG. 5*b* by section markers "A". As can be seen in FIG. 6, contact support 66-1 of mating portion 30-1 (previously described with reference to FIG. 4*d*) is disposed between corresponding contact support 66-2 of connector half 10-2 and the bottom of mating portion 30-2. Similarly, contact support 66-2 of mating portion 30-2 is disposed between corresponding contact support 66-1 of connector half 10-1 and the bottom of connector half 10-1. (Note that since connector half 10-1 is upside-down with respect to connector half 10-2, the bottom of connector half 10-1 is on the top in FIG. 6.) The extent to which mating portions 30-1 and 30-2 can be brought together and engaged within one another is limited, in part, by the sloped edges 46-1 and 46-2 of semi-circular projections 44-1 and 44-2 coming in contact with the back of semi-circular notches 48-2 and 48-1, respectively. The extent to which the mating portions 30-1 and 30-2 can be brought together and engaged within one another is also limited by the alignment of smooth curves 54-1 and 54-2 (not shown in the sectional view of FIG. 6) as previously described with reference to FIG. 5*a*.

As previously noted with reference to FIGS. 4*b* and 4*c*, contact supports 66-1 and 66-2 have disposed on their undersides a plurality of metallic contact strips 68-1 and 68-2, respectively (not shown in FIG. 6). Metallic contact strips 68-1 in mating portion 30-1 are brought into and held in electrical contact with metallic contact strips 68-2 in mating portion 30-2 when connector halves 10-1 and 10-2 are brought together and engaged within one another as shown in FIGS. 5*a*, 5*b*, and 6. The contact between metallic contact strips 68-1 and 68-2 in this manner facilitates electrical connection between conductors 16-1 in cable 12-1 and corresponding conductors 16-2 in cable 12-2. The area of contact between connector strips 68-1 and 68-2 is located in the gap designated as 70 in FIG. 6 between the underside of contact support 66-1 and the underside of contact support 66-2. Note that in FIG. 6, the underside of contact support 66-1 is facing upwards, since mating portion 30-1 is upside-down with respect to mating portion 30-2 in FIG. 6.

In FIGS. 7*a* and 7*b*, greatly enlarged side and top views, respectively, of one of the plurality of metallic contact strips 68-1. It is to be understood, of course, that the plurality of contact strips 68-2 are identical to contact strips 68-1. In the presently disclosed embodiment of the invention, contact strips 68-1 and 68-2 are preferably made of 0.007-inch thick phosphor bronze or other suitable conductive material, as would be known to one of ordinary skill in the art. Contact strip 68-1 comprises a single piece of metal having a curved contact area denoted in FIGS. 7*a* and 7*b* generally as 72-1 and a crimping area denoted generally as 74-1. Crimping area 74-1 is provided with folded-up sides 76-1. As would be apparent to one of ordinary skill in the art, sides 76-1 allow contact strip 68-1 to be crimped onto the end of a wire, such as one of the wires 16-1 in cable 12-1. The end of a wire 16-1 is stripped of a portion of its insulation and placed between the sides 76-1 of the crimping area 74-1 of contact strip 68-1; then, folded-up sides 76-1 of crimping area 74-1 are folded inward toward one another, thus clamping wire 16-1 into place and holding wire 16-1 in electrical contact with strip 68-1.

Once each of the plurality of wires 16-1 has been crimped into its own contact strip 68-1, mating portion 30-1 of connector 10-1 is formed around each of said contact strips 68-1 and wires 16-1, as by an injection molding process or other technique, resulting in the mating portion 30-1 shown in FIG. 8. In FIG. 8, side 52-1 has been "cut away" to reveal how contact strip 68-1 and wire 16-1 are integrally disposed within mating portion 30-1. As shown in FIG. 8, curved contact area 72-1 is disposed on the underside of contact support 66-1, with crimping area being disposed substantially within molded plastic mating portion 30-1. Wires 16-1 (only one of the plurality of wires 16-1 being shown in FIG. 8 for the sake of clarity) extend out of the "T"-shaped projection 42-1 on the back of mating portion 30-1. When connector 10-1 is completely assembled, wire 16-1 will also extend through housing 26-1 comprising upper and lower halves 27-1 and 28-1, respectively, and will exit housing 26-1 through strain relief collar 20-1.

Figure 9A:
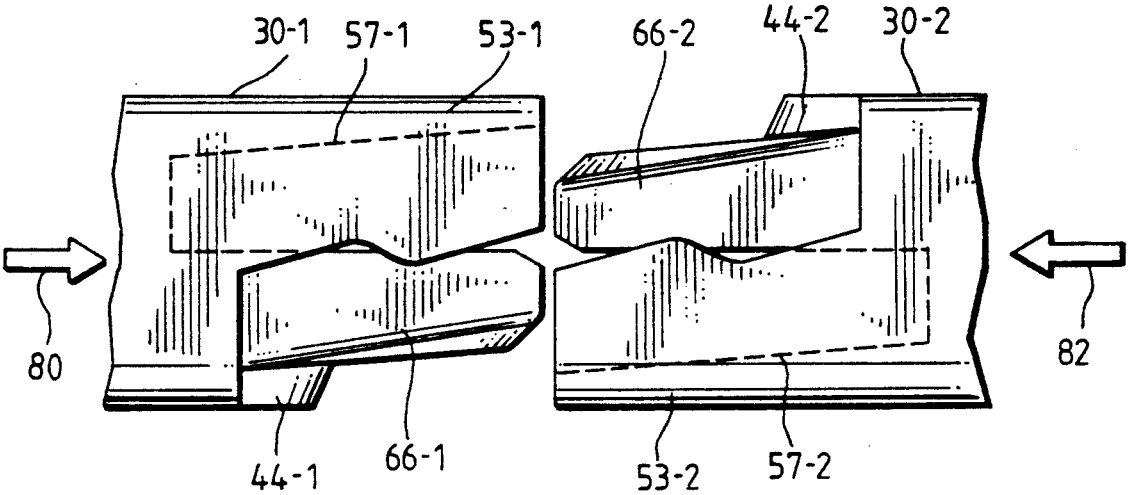
FIGS. 9*a*, 9*b*, 9*c*, and 9*d* are sequential views of the mating portions of the connector of FIG. 1 in the process of being connected.

Turning now to FIGS. 9*a*, 9*b*, 9*c*, and 9*d*, the process of connecting connector halves 10-1 and 10-2 in order to establish electrical contact between contact strips 68-1 and 68-2 shall now be described in greater detail. As previously noted, connection is accomplished by first orienting one of the connector halves upside-down with respect to the other, as shown in FIG. 9*a*. In FIGS. 9*a*–9*d*, the inner surface of planar bottom 53-1 is indicated by dashed line 57-1, as previously indicated in FIG. 4*d*. Similarly the inner surface of planar bottom 53-2 is indicated by dashed line 57-2. Connector halves 10-1 and 10-2 are coupled by pushing them axially together, that is, in the direction of arrows 80 and 82 in FIG. 9*a*.

Figure 9B:
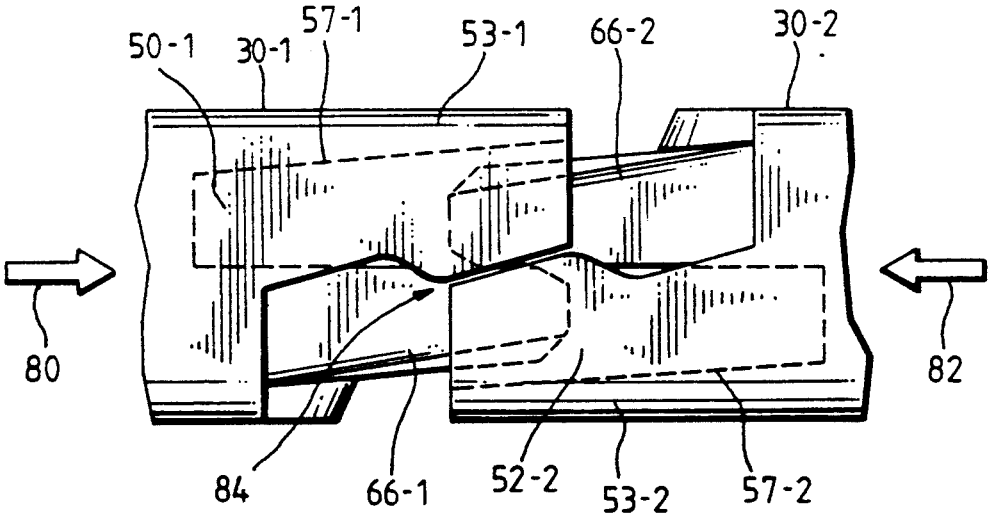

In FIG. 9*b*, mating portions 30-1 and 30-2 are shown in the process of being pushed together. Note in FIG. 9*b* that contact support 66-1 of mating portion 30-1 extends partially into the cavity formed by sides 50-2 and 52-2 and planar bottom 53-2 of mating portion 30-2, with the portion of contact support 66-1 which is obscured from view by side 52-2 of mating portion 30-2 being shown in phantom. Similarly, a portion of contact support 66-2 is obscured from view in FIG. 9*b* by side 50-1 of mating portion 30-1. As can be seen in FIGS. 9*a* and 9*b*, contact support 66-1 is tapered so that it is thinner at its distal end than at its point of attachment to mating portion 30-1; this is due to the sloping of its outer surfaces 62-1 and 58-1, previously described with reference to FIG. 4*d*. Note, also, that the slope of the inner surface 57-1 of planar "bottom" 53-1 causes the cavity of mating portion 30-1 to be wider at its opening than in the rear. Of course, the same is also true for connector 10-2. As a result of this tapering of contact supports 66-1 and 66-2, initially inserting contact support 66-1 into the cavity of mating portion 30-2 and inserting contact support 66-2 into the cavity of mating portion 30-1 is simplified.

In the position shown in FIG. 9*b*, portions of smooth curves 54-1 and 54-2 of respective mating portions 30-1 and 30-2 have begun to come in contact, in the area denoted in FIG. 9*b* generally as 84. As a result of this contact between sides of the respective connector halves, further pressure in the direction of arrows 80 and 82 will meet with some resistance.

Figure 9C:
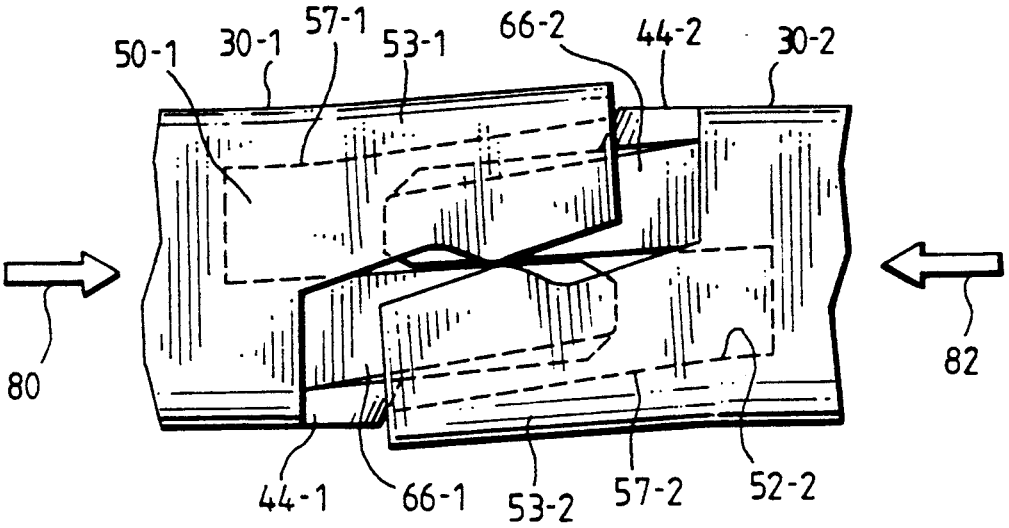

As connector halves 10-1 and 10-2 are pushed further together in the direction of arrows 80 and 82, as shown in FIG. 9*c*, the force exerted on each of the respective sides by one another at their point of contact 84 will cause the sides 50-1, 52-1 and planar "bottom" 53-1 (which is on the top in FIG. 9*c* since connector 10-1 is upside-down) to flex upward, and similarly sides 50-2, 52-2, and planar bottom 53-2 to flex downward.

As connector halves 10-1 and 10-2 are pushed completely together, smooth curves 54-1 and 54-2 will engage one another with a "click" as the flexing of mating portions 30-1 and 30-2 is relieved. Connector halves 10-1 and 10-2 are shown in fully engaged in FIG. 9*d*. The interlocking of smooth curves 54-1 and 54-2 tends to hold connector halves 10-1 and 10-2, until they are pulled apart with enough force to flex the tops and sides of mating portions 30-1 and 30-2 in the same manner as when the connector halves were pushed together.

Figure 9D:
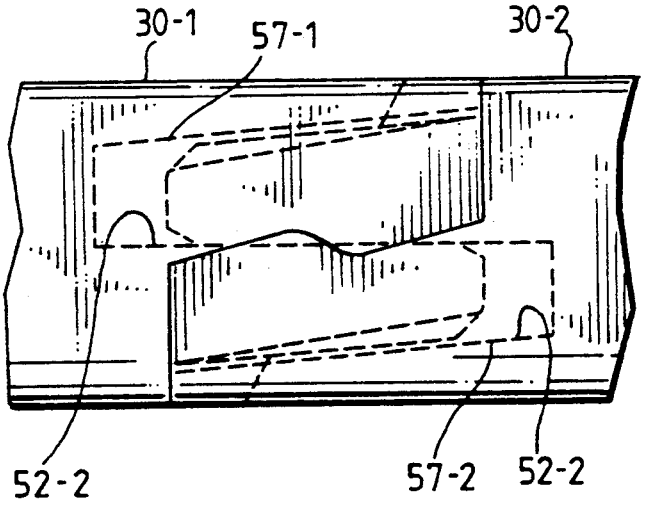

When the two connector halves 10-1 and 10-2 are brought together as shown in FIG. 9*d*, the undersides of contact supports 66-1 and 66-2, having contact strips 68-1 and 68-2, respectively, disposed thereon, will slide past one another, the curved portion of contact strips 68-1 and 68-2 ensuring that once halves 10-1 and 10-2 are completely engaged within one another as shown in FIG. 9*d*, each of the contact strips 68-1 in connector half 10-1 will be pressed into electrical contact with corresponding contact strips 68-1 in connector half 10-2. The curvature of each of the strips 68-1 and 68-2 in contact areas 72-1 and 72-2 maintains a spring force for keeping contact strips 68-1 and 68-2 in contact with one another. Each of pair of contact strips comprising one of the plurality of contact strips 68-1 and the corresponding one of the plurality of contact strips 68-2 will be compressed within gap 70 previously described with reference to FIG. 6.

From the foregoing detailed description of a specific embodiment of the invention, it should be apparent that a lightweight and durable connector which may be quickly separated and re-connected has been disclosed. While a specific embodiment of the invention has been described in detail, it is to be understood that various alterations, substitutions, and modifications can be made therein without departing from the spirit and scope of the present invention as defined in the appended claims. In particular, while an embodiment adapted for use with four-conductor cable commonly used in conjunction with telephone headsets, it should be apparent to one practicing the invention that more or less metallic contact strips may be incorporated into the connector halves, as required for a particular application of the present invention.

What is claimed is:

1. A separable, hermaphroditic connector for electrically coupling first and second multiple-conductor cables, comprising a first connector half to be disposed at an end of said first multiple-conductor cable, and a second connector half to be disposed at an end of said second multiple-conductor cable, each connector half comprising:

a housing of substantially rectangular cross-section;

a mating portion carried on said housing, the rear of said mating portion defining first and second exterior surfaces extending longitudinally with respect to said rectangular housing cross-section, said first exterior surface lying in a first plane;

a substantially planar unitary contact support platform integrally formed with said mating portion and extending longitudinally with respect to said rectangular housing cross-section, said contact support having a top surface stepped down from said first plane so as to lie in a second plane;

a plurality of metallic contact strips disposed on the underside of said unitary, substantially planar contact support, said underside defining a first wall of a substantially rectangular cavity within each said connector half, said top surface of said contact support having a semi-circular projection formed thereon, said semi-circular projection being co-planar with said first exterior surface;

a substantially planar cover integrally formed with said mating portion and disposed in a plane parallel to said contact support underside, said planar cover having sides protruding at right angles therefrom in the direction toward said contact support, said planar cover and sides defining second, third and fourth walls of said cavity, said sides having curved edges, said planar cover lying in a third plane that is co-planar with said second exterior surface and having a semi-circular notch formed in a forward edge thereof;

said curved side edges being configured such that when said contact support of said second connector half is inserted into said cavity of said first connector half, said contact support of said first connector half is inserted into said cavity of said second connector half, and said curved sides of said first connector half interlock with said curved sides of said second connector half, and when interlocked, said curved side edges holding said first and second connector halves together such that said contact strips of said first connector half are held in electrical contact with said contact strips of said second connector half, said semi-circular notch on said planar cover of said first connector half mating with said semi-circular projection on said planar contact support of said second connector half.

* * * * *